US011628539B2

(12) United States Patent
Lin et al.

(10) Patent No.: US 11,628,539 B2
(45) Date of Patent: Apr. 18, 2023

(54) MULTI-DIMENSIONAL VIBRATION GRINDING CAVITY BODY

(71) Applicant: National Chung-Shan Institute of Science and Technology, Taoyuan (TW)

(72) Inventors: Po-Shen Lin, Taoyuan (TW); Ming-Wei Liu, Changhua County (TW); Chih-Peng Chen, Taoyuan (TW); Kuo-Kuang Jen, Taoyuan (TW)

(73) Assignee: National Chung-Shan Institute of Science and Technology, Taoyuan (TW)

( * ) Notice: Subject to any disclaimer, the term of this patent is extended or adjusted under 35 U.S.C. 154(b) by 790 days.

(21) Appl. No.: 16/719,899

(22) Filed: Dec. 18, 2019

(65) Prior Publication Data

US 2021/0187699 A1 Jun. 24, 2021

(51) Int. Cl.

| | |
|---|---|
| ***B24B 31/00*** | (2006.01) |
| ***B24B 31/06*** | (2006.01) |
| ***B24B 31/10*** | (2006.01) |
| ***B24C 5/00*** | (2006.01) |

(52) U.S. Cl.
CPC ..... *B24C 5/005* (2013.01); *B24B 31/06* (2013.01); *B24B 31/10* (2013.01)

(58) Field of Classification Search
CPC ..... B24B 31/00; B24B 31/027; B24B 31/06; B24B 31/10
USPC ..... 451/32, 35, 74, 113, 326, 328, 910
See application file for complete search history.

(56) References Cited

U.S. PATENT DOCUMENTS

| | | | | |
|---|---|---|---|---|
| 4,171,852 | A | 10/1979 | Haentjens | |
| 4,586,293 | A * | 5/1986 | De Spain | B24B 31/062 451/36 |
| 5,997,383 | A * | 12/1999 | Tseng | B24B 31/06 451/36 |
| 7,238,085 | B2 * | 7/2007 | Montierth | A61B 8/546 451/910 |
| 2009/0301764 | A1 * | 12/2009 | Kawamura | B24B 31/06 451/36 |
| 2011/0278231 | A1 * | 11/2011 | Nishijima | B24B 1/04 210/695 |
| 2021/0187686 | A1 * | 6/2021 | Lin | B24B 31/06 |
| 2021/0187699 | A1 * | 6/2021 | Lin | B24B 31/06 |

FOREIGN PATENT DOCUMENTS

| | | | | |
|---|---|---|---|---|
| CN | 105522445 A | * | 4/2016 | B24B 1/00 |
| CN | 105643375 A | * | 6/2016 | B24B 1/04 |
| CN | 108673329 A | | 10/2018 | |
| CN | 110315399 A | * | 10/2019 | |
| EP | 2 886 247 A1 | | 6/2015 | |
| EP | 3838484 A1 | * | 6/2021 | B24B 1/04 |
| EP | 3838485 A1 | * | 6/2021 | B24B 1/04 |
| WO | WO-0032354 A2 | * | 6/2000 | B24B 31/006 |

* cited by examiner

*Primary Examiner* — Eileen P Morgan
(74) *Attorney, Agent, or Firm* — Winston Hsu

(57) ABSTRACT

The present invention discloses a multi-dimensional vibration grinding cavity body. By adjusting amplitudes (power) and frequencies of the multi-dimensional ultrasonic vibration source, such that the multi-directional macroscopic flow is formed in the cavity body while keeping the vibration medium to have the original characteristics to improve the performance of grinding of slurry.

9 Claims, 3 Drawing Sheets

MULTI-DIMENSIONAL VIBRATION GRINDING CAVITY BODY

BACKGROUND OF THE INVENTION

1. Field of the Invention

The present invention relates to a vibration grinding technology, and more particularly, to a multi-dimensional vibration grinding cavity body capable of treating complex surfaces and complex flow paths of additive layer manufacturing.

2. Description of the Prior Art

To ensure that the surface roughness of a processed workpiece meets utilization requirements, there are many equipment and technologies for surface treatment currently, such as sandblast machine, ultrasonic lapping machine, abrasive flow machine, vibration grinding machines, etc. The object with better surface roughness may be obtained from the uneven surface produced by various grinding techniques. Before grinding, the surface of the workpiece was in a matte due to the surface roughness. After grinding, the surface roughness was significantly reduced to show a bright surface, and the detailed surface could meet the requirements of the workpiece.

Regarding surface grinding equipment, the vibration grinder is commonly applied in the art. The main structure of the vibration grinder is a cavity body. A vibration source is disposed outside the cavity, and a vibration medium (abrasive, which can be solid or liquid) and a workpiece to be ground are disposed inside the cavity. After the vibration source is turned on, the workpiece and the abrasive rub each other with the tiny relative movement therebetween, such that the protruding material on the surface of the workpiece may be removed, so as to complete grinding the surface of the workpiece.

Most of the commercial vibration grinders use a motor as the vibration source, disposed below the vibration cavity, and a vibration adjustment device, configured to adjust the amplitude. This structure of the vibration grinder makes the abrasive flow converge toward a center of the cavity body to form a single fixed flow pattern. Therefore, there is a single directional rubbing between the abrasive and the workpiece to be ground. In other words, the workpiece will be ground in another direction after the vibration direction changed, but the grinding procedure is in low efficiency because of the direction of the medium flow and the centroid of the workpiece, causing a limited efficiency for grinding improvement.

In addition, because the direction of single flow pattern is fixed, it cost a lot of time for treating complex surfaces. And, because the abrasive cannot reach the curved deep surface in single flow pattern, some position of the surface cannot be ground, which reduces the efficiency of grinding operations Moreover, a single motor is applied as a vibration source in the prior art. Because the vibration frequency of the motor is not high, it can only make the grinding in the direction of the macroscopic flow and limit the performance of grinding.

SUMMARY OF THE INVENTION

It is therefore a primary objective of the present invention to provide a grinding cavity body of multiple vibration sources, which is more efficient than conventional vibration grinder, to improve over disadvantages of the prior art. The present invention discloses a multi-dimensional vibration grinding cavity body. By adjusting amplitudes (power) and frequencies of the multi-dimensional ultrasonic vibration source, the multi-directional macroscopic flow is formed in the cavity body while keeping the vibration medium to have the original characteristics to improve the performance of grinding of slurry.

The present invention discloses a multi-dimensional vibration grinding cavity body, comprising a cylindrical cavity body, configured to contain an abrasive slurry; at least four ultrasonic vibration sources, disposed uniformly around a sidewall of the cylindrical cavity body, wherein the plurality of ultrasonic vibration sources deliver shock waves toward an interior of the cylindrical cavity body, and directions of the plurality of shock waves, delivered by the plurality of ultrasonic vibration sources, form an angle with a direction of a tangent plane of the sidewall, on which the ultrasonic vibration sources are disposed, wherein the angle is 15°-45°, and the plurality of shock waves, delivered by the plurality of ultrasonic vibration sources, make a convolutional flow pattern of the abrasive slurry in the cylindrical cavity body; and a turntable disc, disposed inside a bottom of the cylindrical cavity body, wherein the turntable disc rotates in a direction cooperating with directions of the shock waves to enhance performance of the convolutional flow of the abrasive slurry in the cylindrical cavity body.

In an embodiment of the present invention, a multi-dimensional vibration grinding cavity body comprises a cuboid cavity body, configured to contain an abrasive slurry; at least four ultrasonic vibration sources, disposed respectively on four sidewalls of the cuboid cavity body, and not in a central axis of the sidewall, wherein the plurality of ultrasonic vibration sources deliver a plurality of shock waves toward an interior of the cuboid cavity body, and the plurality of shock waves, delivered by the plurality of ultrasonic vibration sources, make a convolutional flow pattern of the abrasive slurry in the cylindrical cavity body; and a turntable disc, disposed inside a bottom of the cuboid cavity body, wherein the turntable disc rotates in a direction cooperating with directions of the shock waves to enhance performance of the convolutional flow of the abrasive slurry in the cuboid cavity body.

In an embodiment of the present invention, the plurality of vibration frequencies of the ultrasonic vibration sources are 10 KHz-50 KHz, and the vibration frequencies and amplitudes can be adjusted during the grinding process, to meet the requirements of the different workpiece and grinding mediums.

In an embodiment of the present invention, at least one auxiliary ultrasonic vibration source is further disposed on the bottom of the cylindrical or cuboid cavity body.

In an embodiment of the present invention, the plurality of vibration frequencies of the auxiliary ultrasonic vibration sources are 10 KHz-50 KHz.

In an embodiment of the present invention, the cuboid cavity body is by replacing a polygonal cavity body with at least four sides.

In order to make the objects, technical solutions and advantages of the present invention become more apparent, the following relies on the accompanying drawings and embodiments to describe the present invention in further detail.

These and other objectives of the present invention will no doubt become obvious to those of ordinary skill in the art after reading the following detailed description of the preferred embodiment that is illustrated in the various figures and drawings.

DETAILED DESCRIPTION

The embodiments stated below are utilized for illustrating the concept of the present application. Those skilled in the art can readily understand the advantages and effects of the present invention disclosed by the application.

FIG. 1-4 are schematic diagrams of a multi-dimensional vibration grinding cavity body according to a first embodiment of the present invention. Please refer to FIG. 1A, which is the first embodiment. The first embodiment comprises: a cuboid cavity body 11, configured to contain an abrasive slurry; at least four ultrasonic vibration sources 12, disposed respectively on four sidewalls of the cuboid cavity body, and not in a central axis of the sidewall, wherein the plurality of ultrasonic vibration sources 12 deliver a plurality of shock waves toward an interior of the cuboid cavity body 11; a turntable disc 13, disposed inside a bottom of the cuboid cavity body 11.

Figure 1:
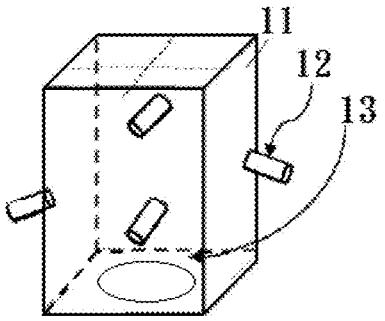
FIG. 1-4 are schematic diagrams of a multi-dimensional vibration grinding cavity body according to a first embodiment of the present invention.
Figure 2:
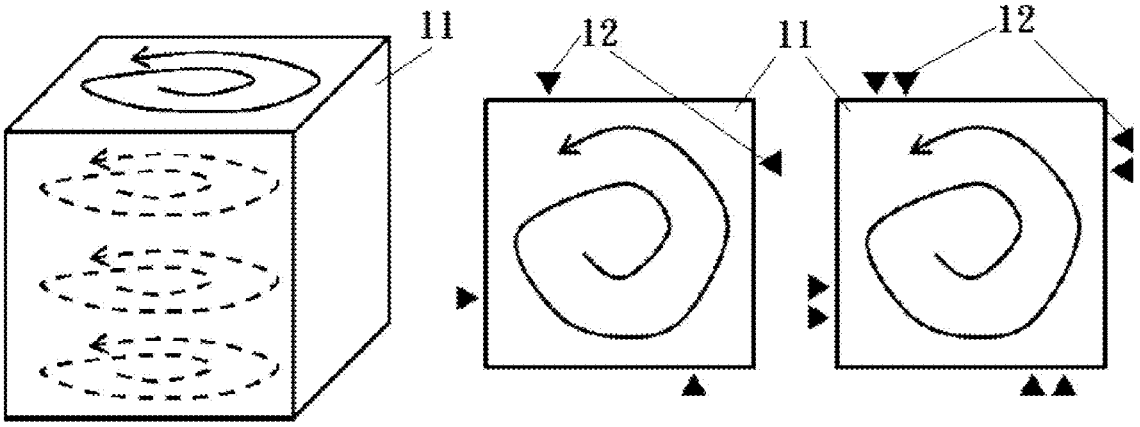

Please refer to FIG. 2, which is a schematic diagram showing that in the first embodiment of the present invention, the at least four ultrasonic vibration sources 12 deliver a shock wave to make the slurry flow in the cuboid cavity body 11 and generate the convolutional flow, causing that the abrasive medium of slurry may enter the complex surface of the workpiece (not shown in the figure), which is needed to be processed and disposed inside the cuboid cavity body 11, to enhance the performance of grinding. The turntable disc 13 rotates in a direction cooperating with directions of the shock waves, which are delivered by the plurality of ultrasonic vibration sources 12, to enhance the performance of the convolutional flow of the abrasive slurry in the cuboid cavity body 11. The number and power of the ultrasonic vibration sources 12, and the frequency of the shock wave may be changed. Preferably, the number of the ultrasonic vibration sources 12 is a multiple of 4, and the vibration frequencies of shock waves are 10 KHz-50 KHz.

Figure 3:
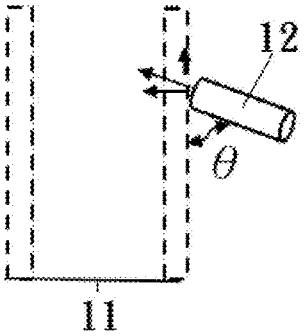

Please refer to FIG. 3, which is a schematic diagram showing that in the first embodiment of the present invention, there is an included angle θ, which is 15°-45°, between the ultrasonic vibration sources 12 and the sidewalls of the cuboid cavity body 11. The ultrasonic vibration sources 12 may deflect vertically or horizontally to enhance the horizontal and vertical flow component to the medium (slurry) in the cuboid cavity body 11 to solve the problem of uniformly flow energy with low fluidity medium and make the flow pattern of the medium (slurry) uniform.

Figure 4:
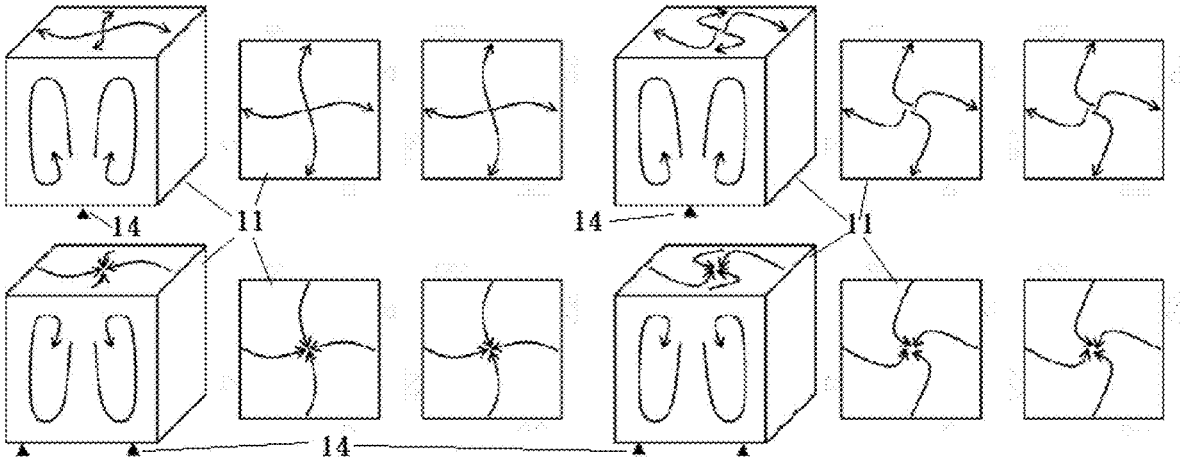
Figure 5:
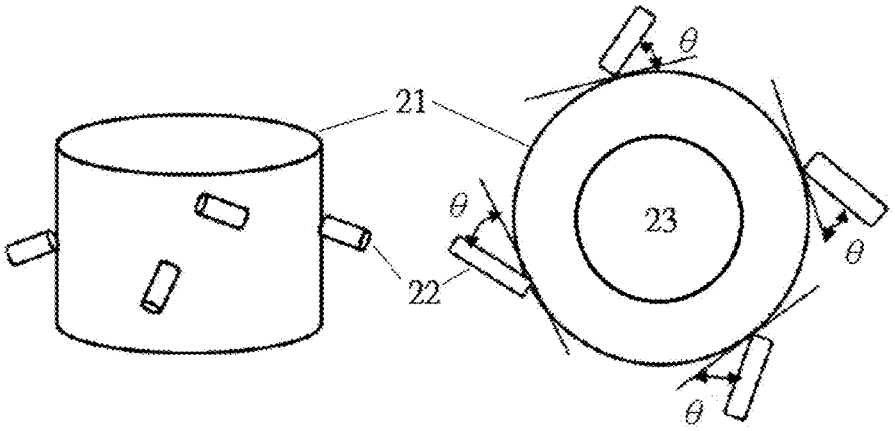
FIG. 5-7 are schematic diagrams of a multi-dimensional vibration grinding cavity body according to a second embodiment of the present invention.

Please refer to FIG. 4, which is a schematic diagram showing that in the first embodiment of the present invention, at least one auxiliary ultrasonic vibration source 14 may be disposed on the bottom of the cuboid cavity body 11. The vibration of the auxiliary ultrasonic vibration source 14 is utilized to increase the up-and-down flow pattern of vibration. By adjusting the power and frequency according to the needs of each type of medium, the 4 flow patterns, shown in FIG. 4, may be implemented. Thus, the diversity of the flow pattern of the medium in equipment may be increased to meet the requirements of different workpieces.

FIG. 5-8 are schematic diagrams of a multi-dimensional vibration grinding cavity body according to a second embodiment of the present invention. Please refer to FIG. 5, which is a cross-section view and a top view of the second embodiment. The second embodiment comprises: a cylindrical cavity body 21, configured to contain an abrasive slurry; at least four ultrasonic vibration sources 22, disposed uniformly around a sidewall of the cylindrical cavity body 21, and directions of the plurality of shock waves, delivered by the plurality of ultrasonic vibration sources, form an included angle with a direction of a tangent plane of the sidewall, on which the ultrasonic vibration sources are disposed, wherein the angle is 15°-45°; a turntable disc 23, disposed on an inside of a bottom of the cylindrical cavity body 21.

Figure 6:
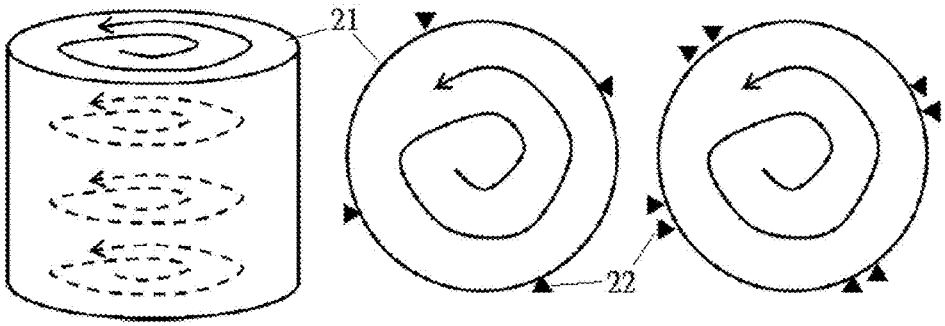

Please refer to FIG. 6, which is a schematic diagram showing that in the second embodiment of the present invention, the at least four ultrasonic vibration sources 22 deliver a shock wave to make the slurry flow in the cylindrical cavity body 21 and generate the convolutional flow, causing that the abrasive medium of slurry may enter the complex surface of the workpiece (not shown in the figure), which is needed to be processed and disposed inside the cylindrical cavity body 21, to enhance the performance of grinding. The turntable disc 23 rotates in a direction cooperating with directions of the shock waves, which are delivered by the plurality of ultrasonic vibration sources 22, to enhance the performance of the convolutional flow of the abrasive slurry in the cuboid cavity body 21. The number and power of the ultrasonic vibration sources 22, and the frequency of the shock wave may be changed. Preferably, the number of the ultrasonic vibration sources 22 is a multiple of 4, and the vibration frequency of shock waves is 10 KHz-50 KHz.

Please refer to FIG. 5 again, which is a schematic diagram showing that in the second embodiment of the present invention, there is an included angle θ, which is 15°-45°, between the ultrasonic vibration sources 22 and the sidewalls of the cylindrical cavity body 21. The ultrasonic vibration sources 22 may deflect vertically or horizontally to enhance the horizontal and vertical flow component to the medium (slurry) in the cuboid cavity body 21 to solve the problem of uniformly flow energy with low fluidity medium and make the flow pattern of the medium (slurry) uniform.

Figure 7:
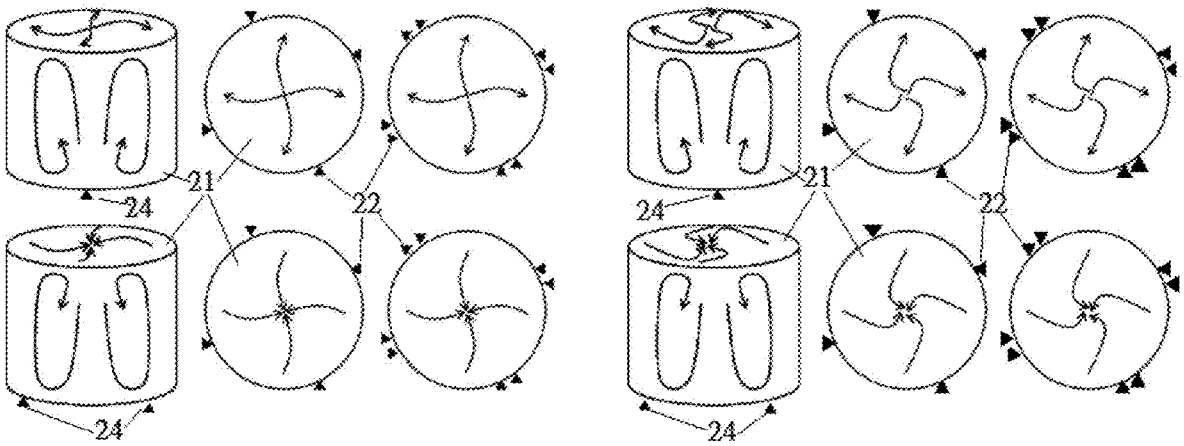

Please refer to FIG. 7, which is a schematic diagram showing that in the second embodiment of the present invention, at least one auxiliary ultrasonic vibration source 24 may be disposed inside the bottom of the cylindrical cavity body 21 to cooperate with the plurality of the shock waves, which are delivered by the ultrasonic vibration sources 22 in the sidewalls. The vibration of the auxiliary ultrasonic vibration source 24 is utilized to increase the up-and-down flow pattern of vibration. By adjusting the power and frequency according to the needs of each type of medium, the 4 flow patterns, shown in FIG. 7, may be implemented. Thus, the diversity of the flow pattern of the medium in equipment may be increased to meet the requirements of different workpieces.

Therefore, the present invention provides a multi-dimensional vibration grinding cavity body. By adjusting amplitudes (power) and frequencies of the multi-dimensional ultrasonic vibration source, the multi-directional macroscopic flow is formed in the cavity body while keeping the vibration medium to have the original characteristics to improve the performance of grinding of slurry. The present invention utilizes the multi-dimensional vibration source controlling to form the multi-directional (convolutional)

flow pattern of medium to meet the requirements of the different workpiece and grinding mediums and shorten the time for grinding, and control the direction precisely. Multiple vibration sources may control the direction of multi-directional macroscopic flow to help the vibration medium (the abrasive of the slurry) to enter the fine structure of the workpiece to be processed. The ultrasonic vibration sources and the turntable disc cooperate to generate the vibration in the convolutional flow pattern of slurry to grind. Not only the macroscopic flow but also the vibration of abrasive improves the performance of grinding to the workpiece to be ground.

The foregoing embodiments are not intended to limit the present application. Those skilled in the art may make modifications and alterations accordingly and not limited herein. Therefore, the scope of the present invention should be as listed in the scope of the claims mentioned below.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-dimensional vibration grinding cavity body, comprising:

a cylindrical cavity body, configured to contain an abrasive slurry;

at least four ultrasonic vibration sources, disposed uniformly around a sidewall of the cylindrical cavity body, wherein the plurality of ultrasonic vibration sources deliver shock waves toward an interior of the cylindrical cavity body, and directions of the plurality of shock waves, delivered by the plurality of ultrasonic vibration sources, form an angle with a direction of a tangent plane of the sidewall, on which the ultrasonic vibration sources are disposed, wherein the angle is 15°-45°, and the plurality of shock waves, delivered by the plurality of ultrasonic vibration sources, make a convolutional flow pattern of the abrasive slurry in the cylindrical cavity body; and a turntable disc, disposed inside a bottom of the cylindrical cavity body, wherein the turntable disc rotates in a direction cooperating with directions of the shock waves to enhance performance of the convolutional flow of the abrasive slurry in the cylindrical cavity body.

2. The multi-dimensional vibration grinding cavity body of claim 1, wherein vibration frequencies of the ultrasonic vibration sources are 10 KHz-50 KHz.

3. The multi-dimensional vibration grinding cavity body of claim 1, further comprising at least one auxiliary ultrasonic vibration source, disposed on the bottom of the cylindrical cavity body.

4. The multi-dimensional vibration grinding cavity body of claim 3, wherein a vibration frequency of the at least one auxiliary ultrasonic vibration source is 10 KHz-50 KHz.

5. A multi-dimensional vibration grinding cavity body, comprising:

a cuboid cavity body, configured to contain an abrasive slurry;

at least four ultrasonic vibration sources, disposed respectively on four sidewalls of the cuboid cavity body, and not in a central axis of the sidewall, wherein the plurality of ultrasonic vibration sources deliver a plurality of shock waves toward an interior of the cuboid cavity body, and the plurality of shock waves, delivered by the plurality of ultrasonic vibration sources, make a convolutional flow pattern of the abrasive slurry in the cylindrical cavity body; and a turntable disc, disposed inside a bottom of the cuboid cavity body, wherein the turntable disc rotates in a direction cooperating with directions of the shock waves to enhance performance of the convolutional flow of the abrasive slurry in the cuboid cavity body.

6. The multi-dimensional vibration grinding cavity body of claim 5, wherein vibration frequencies of the ultrasonic vibration sources are 10 KHz-50 KHz.

7. The multi-dimensional vibration grinding cavity body of claim 5, further comprising at least one auxiliary ultrasonic vibration source, disposed on the bottom of the cuboid cavity body.

8. The multi-dimensional vibration grinding cavity body of claim 7, wherein a vibration frequency of the at least one auxiliary ultrasonic vibration sources is 10 KHz-50 KHz.

9. The multi-dimensional vibration grinding cavity body of claim 5, wherein the cuboid cavity body is by replacing a polygonal cavity body with at least four sides.

* * * * *